United States Patent [19]

Nixon

[11] 4,406,975

[45] Sep. 27, 1983

[54] LAMPS

[75] Inventor: Ralph D. Nixon, Braintree, England

[73] Assignee: English Electric Valve Company, Chelmsford, England

[21] Appl. No.: 185,380

[22] Filed: Sep. 8, 1980

[30] Foreign Application Priority Data

Sep. 6, 1979 [GB] United Kingdom ..... 7930931

[51] Int. Cl.[3] ..... H01J 63/06; H01J 29/96

[52] U.S. Cl. ..... 315/209 R; 307/326; 313/51; 313/495; 315/51; 315/58; 328/7

[58] Field of Search ..... 315/51–53, 315/58, 71, 200 R, 209 R; 313/51, 299, 318, 483, 495, 496; 331/63; 328/7; 307/326, 328

[56] References Cited

U.S. PATENT DOCUMENTS 4,063,108 12/1977 Klett et al. ..... 307/326 X
4,173,730 11/1979 Young et al. ..... 315/53

FOREIGN PATENT DOCUMENTS 2389226 12/1978 France ..... 313/483
312267 4/1929 United Kingdom .
402747 12/1933 United Kingdom .
539287 9/1941 United Kingdom .
646431 11/1950 United Kingdom .
697096 9/1953 United Kingdom .
789078 1/1958 United Kingdom .
1372935 11/1974 United Kingdom .
1414411 11/1975 United Kingdom .
2006517 5/1979 United Kingdom .

*Primary Examiner*—Eugene R. La Roche
*Attorney, Agent, or Firm*—Spencer & Kaye

[57] ABSTRACT

A lamp consists of a high voltage power supply 5 mounted on an evacuated envelope 1. The lamp glows when electrons from a cathode 2 strike a phospher coating 4 on the inside surface of the envelope. The lamp is mounted so that it can be separated from the power supply and provision is made to inhibit the generation of the very high anode potential by the power supply unless it is correctly mounted on the envelope.

5 Claims, 2 Drawing Figures

LAMPS

BACKGROUND OF THE INVENTION

This invention relates to lamps, and in particular it is concerned with lamps which are capable of operating in an efficient manner by converting a large proportion of the energy supplied to them into visible light.

SUMMARY OF THE INVENTION

According to a first aspect of this invention, a lamp includes an evacuated envelope within which are mounted an electron emissive cathode and an anode, with a light transmissive portion of the envelope being provided with an internal layer of fluorescent material so that light is emitted through said portion when electrons are incident upon said fluorescent material; a power supply which is mounted on said envelope in a manner so as to be separable therefrom and which is provided with an electrical plug dimensioned and arranged to cooperate as a lamp socket, means for receiving a.c. power via said plug and means for deriving therefrom a d.c. anode potential for said evacuated envelope; and means for inhibiting the generation of said d.c. anode potential unless the power supply is mounted on the said evacuated envelope.

According to a second aspect of this invention, an evacuated envelope suitable for use with a lamp as defined above includes an electron emissive cathode and an anode, with a light transmissive portion of the envelope being provided with a layer of fluorescent material on its inner surface so that light is transmitted through said light transmissive portion when electrons are incident upon said fluorescent material and means for coupling the envelope in a separable manner to a power supply.

According to a third aspect of this invention a power supply suitable for use with a lamp as defined above includes an electrical plug dimensioned and arranged to cooperate with a lamp socket, means for receiving a.c. power via said plug and means for deriving therefrom a d.c. anode potential, means for mounting the power supply on an evacuated envelope and means for inhibiting generation of said d.c. potential unless the power supply is mounted on a said evacuated envelope.

Preferably the electrical plug comprises a standard bayonet lamp fitting.

The means for inhibiting generation of said d.c. potential may comprise an electrical switch which is closed by the presence of the evacuated envelope when the power supply is mounted upon it.

Preferably, however, the evacuated envelope carries an electrical conductor which is arranged to complete a circuit forming part of said power supply. The latter alternative provides a more secure construction since the power supply cannot be readily energised simply by closing a switch in an unintentional manner.

Preferably again the power supply includes a high frequency oscillator, which forms part of a step-up voltage generator. Typically, the oscillator can operate at a frequency of about 10 kHz, and at this frequency the size of a step-up transformer can be relatively small so as to be compatible in size with a standard light fitting.

The invention is further described by way of example with reference to the accompanying drawings, in which

DESCRIPTION OF THE PREFERRED EMBODIMENT

Figure 1:
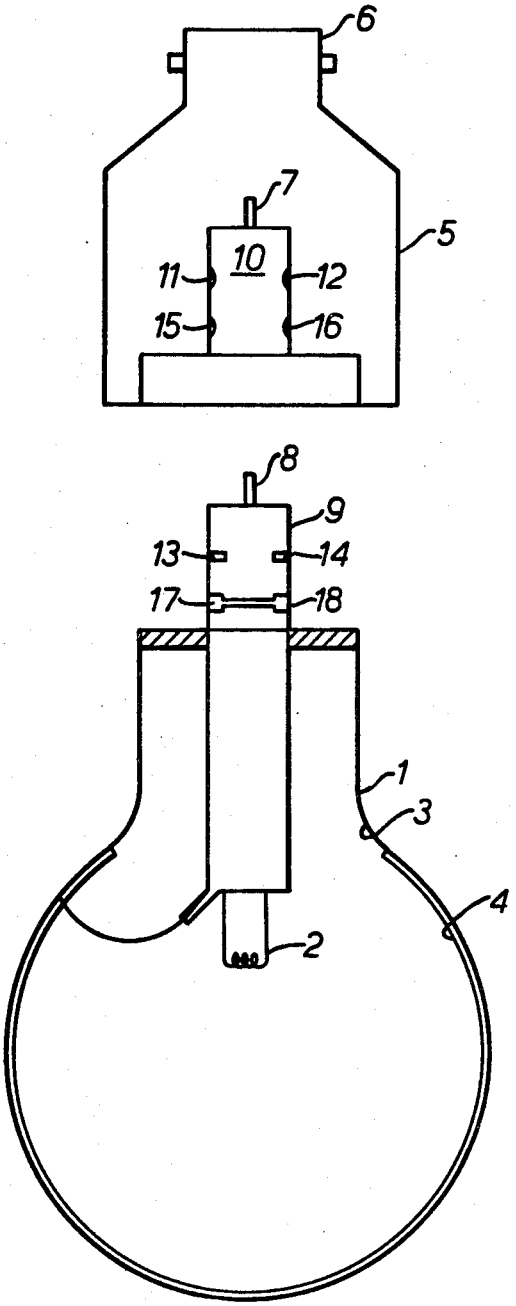
FIG. 1 illustrates a lamp in accordance with the present invention.

Referring to FIG. 1, an evacuated envelope 1 is provided with an internally mounted cathode 2 and an anode 3, the latter being constituted by a transparent conductive coating formed on the internal surface of the envelope 1. The anode 3 is provided with a layer of phosphor 4 and in operation electrons from the cathode 2, which strike the anode 3 stimulate the phosphor 4 to emit light in a very efficient manner.

So that the electrons can travel from the cathode 2 to the anode 3, without being unduly absorbed it is necessary for a high degree of vacuum to exist within the envelope. In order for the energy of the electrons to be converted to light in an efficient manner the incident electrons must possess a relatively high energy when they strike the phosphor. To achieve this high energy an anode potential of between 5 kV and 15 kV is desirable and this voltage is derived from a power supply 5.

The power supply 5 is provided with a bayonet plug 6, which is arranged and dimensioned so as to be compatible with a standard light fitting. In this way the power supply 5 receives alternating voltage having a value typically of 240 volts at a frequency of 50 cycles per second. The power supply 5 is arranged to generate an anode potential of between 5 kV and 15 kV and to apply it to an electrical terminal 7, which cooperates with a pin 8 mounted on the evacuated envelope 1. In operation, the stem 9 attached to the evacuated envelope 1 is inserted into the recess 10 to the power supply 5. The current necessary to heat the cathode 2 can be obtained in the form of an a.c. waveform which is tapped directly as a fraction of the mains voltage and this is applied to a pair of terminals 11 and 12, which cooperate with contacts 13 and 14 on the stem 9. Additionally, the terminals 15 and 16 are provided in the recess 10 and when the stem 9 is inserted into this recess they are arranged to cooperate with contacts 17 and 18 respectively. The terminals 17 and 18 are directly linked by means of a conductive collar which completely surrounds the stem 9 so as to provide a short circuit between the contacts 15 and 16.

Figure 2:
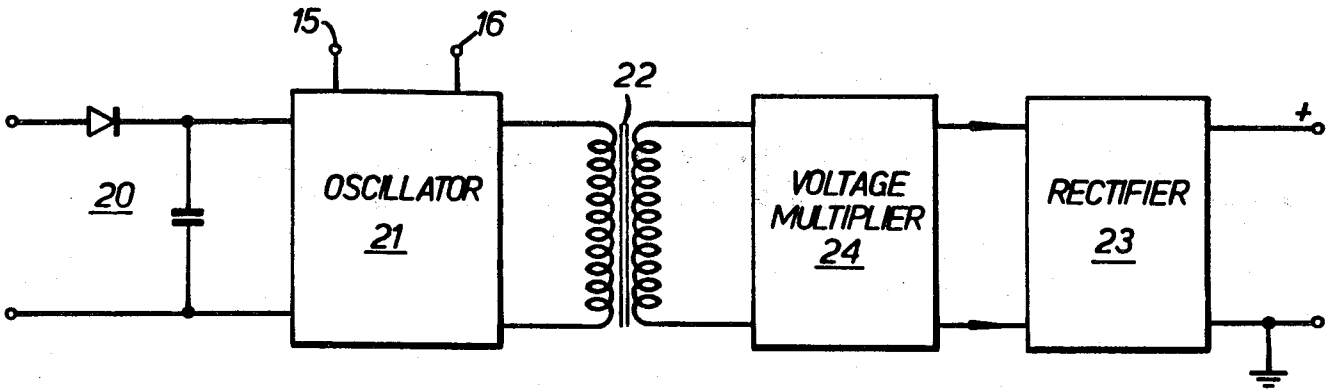
FIG. 2 shows a power supply forming part of the lamp.

Referring to FIG. 2, the power supply 5 includes a rectifier stage 20 and an oscillator 21. The rectifier stage 20 acts as a d.c. power source for the oscillator 21, which produces high frequency oscillations whenever power of the correct voltage is applied to it. The oscillator 21 may take any convenient form and preferably it is a high frequency oscillator having a natural frequency of oscillation of the order of 20 kHz which is above the normal audio frequency range. The oscillator 21 is provided with two terminals 15 and 16, which correspond to those shown in FIG. 1, and it is arranged such that it will only oscillate when a short circuit exists between these two terminals. The high frequency provided by the oscillator 21 is applied to a step-up transformer 22 which generates a very high a.c. potential. This potential is subsequently rectified by a rectifier 23 and it then constitutes an anode potential for the evacuated envelope 1. If required, the anode potential can be further increased by means of conventional voltage multiplier circuit 24 interposed between the transformer 22 and the rectifier. In practice, it would probably be most convenient to generate a voltage of between 3 and 4 kV by means of the transformer 22, and to subsequently multiply this voltage by a factor of three to obtain the required anode potential.

It will thus be seen that unless the evacuated envelope 1 is correctly inserted into the power supply 5, the high potential which is of the order of 5 to 15 kVs cannot be produced, thereby ensuring the safety of a user. By suitably shaping the recess 10 and the position of the contacts 15 and 16, the likelihood of these two contacts being arranged accidentally can be minimised.

It is desirable to make the envelope 1 separable from the power supply 5, since whilst it is expected that the power supply will have a long life, the useful operating lifetime of the envelope 1 will be more limited as the envelope is relatively fragile and the cathode efficiency decreases significantly with age.

I claim:

1. A lamp including an evacuated envelope within which are mounted an electron emissive cathode and an anode, with a light transmissive portion of the envelope being provided with an internal layer of fluorescent material so that light is emitted through said portion when electrons are incident upon said fluorescent material; a power supply which is mounted on said envelope in a manner so as to be separable therefrom and which is provided with an electrical plug dimensioned and arranged to cooperate as a lamp socket, means for receiving a.c. power via said plug and means for deriving therefrom a d.c. anode potential for said evacuated envelope; and means for inhibiting the generation of said d.c. anode potential unless the power supply is mounted on the said evacuated envelope.

2. A lamp as claimed in claim 1 and wherein the electrical plug comprises a standard bayonet lamp fitting.

3. A lamp as claimed in claim 1 or 2 and wherein the means for inhibiting generation of said d.c. potential comprises an electrical switch which is closed by the presence of the evacuated envelope when the power supply is mounted upon it.

4. A lamp as claimed in claim 1 or 2 and wherein the evacuated envelope carries an electrical conductor which is arranged to comlete a circuit forming part of said power supply.

5. A lamp as claimed in claim 1 and wherein the power supply includes a high frequency oscillator, which forms part of a step-up voltage generator.

* * * * *